US005848696A

United States Patent [19]

Christ et al.

[11] Patent Number: 5,848,696

[45] Date of Patent: Dec. 15, 1998

[54] WRAPPED MATERIAL, AND METHOD AND APPARATUS FOR WRAPPING AND UNWRAPPING SUCH MATERIAL

[75] Inventors: Dennis L. Christ, Scandia; Timothy D. Bredahl, Cottage Grove; Michael A. Giefer, Woodbury; Robert D. Hamann, Eagan; Donald R. Peacock; Timothy J. Walker, both of St. Paul, all of Minn.

[73] Assignee: Minnesota Mining & Manufacturing Company, St. Paul, Minn.

[21] Appl. No.: 753,461

[22] Filed: Nov. 25, 1996

[51] Int. Cl.[6] ..... B65D 65/00

[52] U.S. Cl. ..... 206/447; 206/412

[58] Field of Search ..... 428/35.7, 36.8; 206/447, 389, 390, 412, 813

[56] References Cited

U.S. PATENT DOCUMENTS

| | | | |
|---|---|---|---|
| 2,762,504 | 9/1956 | Sparks et al. . | |
| 2,975,150 | 3/1961 | Johnson et al. . | |
| 3,317,368 | 5/1967 | Battersby . | |
| 3,418,059 | 12/1968 | Robe . | |
| 3,644,169 | 2/1972 | Phillips . | |
| 3,917,123 | 11/1975 | Grenfell . | |
| 3,986,640 | 10/1976 | Redmond . | |
| 4,054,632 | 10/1977 | Franke . | |
| 4,093,485 | 6/1978 | Ornsteen . | |
| 4,112,158 | 9/1978 | Creekmore et al. | 206/447 X |
| 4,248,348 | 2/1981 | Butler et al. | 206/447 X |
| 4,490,424 | 12/1984 | Gerace . | |
| 4,755,245 | 7/1988 | Viel . | |
| 4,774,123 | 9/1988 | Dziki . | |
| 4,871,590 | 10/1989 | Merz et al. . | |
| 4,925,512 | 5/1990 | Briand . | |
| 5,257,491 | 11/1993 | Rouyer et al. . | |
| 5,333,439 | 8/1994 | Bozich et al. . | |
| 5,373,682 | 12/1994 | Hatfield et al. . | |
| 5,392,592 | 2/1995 | Bozich et al. . | |
| 5,443,903 | 8/1995 | Hansen . | |

FOREIGN PATENT DOCUMENTS

| | | |
|---|---|---|
| 1 963 884 | 12/1969 | Germany . |
| 32 34 065 A1 | 4/1983 | Germany . |
| 31 38 222 C1 | 5/1983 | Germany . |
| 1095735 | 12/1967 | United Kingdom . |
| 2 135 238 | 8/1984 | United Kingdom . |

*Primary Examiner*—Jacob K. Ackun
*Attorney, Agent, or Firm*—James J. Trussell

[57] ABSTRACT

An elongate mass of material wrapped by a liner in which the liner is wrapped around the material with the liner inside surface facing the peripheral surface of the material, with first and second regions of the liner extending away from the material with the liner inside surface of the first region in unbonded contact with the liner inside surface of the second region so as to enclose the material with said liner. The material and the center region of the liner together form a core of the wrapped mass of material, and the first and second liner regions together form a tab of the wrapped mass of material. The wrapped mass of material includes a first portion and a second portion and is arranged such that the core of a second portion applies sufficient force to the tab of a first portion so as to maintain the mass of material enveloped by the liner at the first portion. Also presented are methods and apparatus for wrapping and unwrapping such material. A preferred embodiment of the invention provides a cold-flowable material such as a hot-melt pressure sensitive adhesive wrapped in a liner such that the liner is easily removed from the material.

14 Claims, 10 Drawing Sheets

WRAPPED MATERIAL, AND METHOD AND APPARATUS FOR WRAPPING AND UNWRAPPING SUCH MATERIAL

TECHNICAL FIELD

The present invention relates generally to a wrapped mass of material and to methods and apparatus for wrapping and unwrapping such material. The present invention relates more particularly to a cold-flowable material such as a hot-melt pressure sensitive adhesive wrapped in a liner such that the liner is easily removed from the material, and a method and apparatus for wrapping and unwrapping the material with the liner.

BACKGROUND OF THE INVENTION

There have been several attempts to provide a means to package and handle materials such a hot melt pressure sensitive adhesives. For example, U.S. Pat. No. 5,392,592, "Hot-Melt Pressure Sensitive Adhesive Packaging, Preform, and Method," (Bozich et al.), describes a method for waste-free packaging for a hot-melt pressure sensitive adhesive that comprises extruding a hot-melt pressure sensitive adhesive into a continuous tubular film, wherein the film is compatible with being integrated into the composition of the hot-melt adhesive composition. In one embodiment, the preform of the packaging material of Bozich et al. comprises a continuous sheet of a heat sealable film having two opposed edges, with a patterned silicone coating on at least one face leaving an uncoated area. The uncoated area on the first edge is capable of forming a heat seal with a second uncoated area on either face in proximity to the opposite edge. The heat sealable film must be capable of being sealed by the application of heat or a hot-melt adhesive. Hot melt adhesive is then extruded into the tubular film and the tube is crimped to isolate desired amounts of adhesive between crimps. By melting the compatibly packaged hot melt adhesive in a glue pot, the compatible packaging becomes compatibly integrated into the molten hot melt adhesive composition.

U.S. Pat. No. 5,373,682, "Method for Tackless Packaging of Hot Melt Adhesives," (Hatfield et al.), discusses packaging a non-blocking hot-melt adhesive by directly pouring or pumping the molten adhesive into a cylindrical plastic tube, the tube being in contact with a heat sink. The tube comprises a thermoplastic film which is meltable together with the adhesive composition and blendable into the molten adhesive and which will not deleteriously affect the properties of the adhesive composition when blended therewith. In one embodiment, the plastic film is threaded through a film folder which folds the film and forms a lap seal around a fill pipe or mandrel. The lap seal is sealed with hot air, induction welding or ultrasonic welding. The molten hot-melt adhesive is then pumped into the tube. The adhesive filled tube is then crimped or pinched into smaller cartridge size segments.

U.S. Pat. No. 3,418,059, "Dispenser Package for Flowable Materials and Method of Forming Same," (Robe), discusses a dispenser package in the form of a flexible pouch having a constricted throat orifice separating the main portion of the pouch from a dispenser portion. A method is provided for forming the pouch by forming a tube of a thermoplastic material, and using a heat sealing device to form the material into a tube, then gathering the tube material at spaced locations and applying heat to form a thickened, stiffened portion at the throat orifice.

U.K. Patent Application GB 2,135,238A, "Producing Tubes for Packages," discusses a tube for packaging in which a mandrel is used to provide a tubular packaging means having a longitudinal seam formed as a sealed film. This application also discusses a method of producing tubular packaging means from a flat length of film, in particular heat sealable film, which comprises folding a length of film about a sealing mandrel to bring two longitudinal edges of the film against each other alongside the sealing mandrel, sealing the two edges to form a sealed film, and drawing the tubular piece off the sealing mandrel.

U.S. Pat. No. 4,755,245, "Method for Conditioning a Permanent Adhesive Composition in the Form of Blocks or Sections," (Viel), discusses several prior proposed and implemented methods to package adhesive compositions. The methods discussed in Viel include providing permanent adhesive compositions in the form of rods, blocks, strips, sections, and slabs, which are enveloped by a thin film. Viel characterizes the method of wrapping with film as costly. Veil also points out that the choice of films suitable for such protection is fairly limited since it is absolutely essential that they blend perfectly with the composition during re-melting of the latter when used, as the protected composition is now inseparable from its protective film.

It is also known to provide hot melt adhesives in the form of a coextruded core/sheath composite, in which the sheath is relatively non-tacky and can be mixed with the material of the core upon remelt of the composite. It is also known that such composites can be coiled about a spool. See, for example, U.S. Pat. Nos. 3,317,368 and 4,490,424, and U.K. Patent Specification 1,095,735.

SUMMARY OF THE INVENTION

The present invention provides generally a wrapped mass of material and methods and apparatus for wrapping and unwrapping such material. A preferred embodiment of the invention provides a cold-flowable material such as a hot-melt pressure sensitive adhesive wrapped in a liner such that the liner is easily removed from the material. The present invention also provides a method and apparatus for wrapping and unwrapping the material with the liner. The present invention is also useful for wrapping difficult to handle materials, such as materials which stick or bond to themselves. The present invention is also useful with materials which are not coherent or strong enough to be drawn through processing or delivery apparatuses themselves, but which can be easily packaged and handled according to the present invention by drawing the liner which wraps the material. This can include materials in particulate form.

One aspect of the present invention presents a wrapped mass of material. The wrapped mass of material comprises an elongate mass of material including an outer peripheral surface and a liner. The liner includes an inside surface, an outside surface, a first edge, and a second edge, with the first and second edges opposite to one another. The liner also includes a first region extending along the first edge, a second region extending along the second edge, and a center region between the first and second regions. The liner is wrapped around the mass of material with the liner inside surface at the center region facing the peripheral surface of the mass of material, the liner first and second regions extending away from the mass of material with the liner inside surface of the first region contacting the liner inside surface of the second region so as to enclose the mass of material within the liner. The mass of material and the center region of the liner together form a core of the wrapped mass of material, and the first region and the second region together form a tab of the wrapped mass of material. The wrapped mass of material includes a first portion and a second portion and is arranged such that the tab of the first portion and the core of the second portion contact one another so as to maintain the mass of material enveloped by the liner at the first region.

In one preferred embodiment of the above wrapped mass of material, the mass of material comprises a cold-flowable material. In one aspect of this embodiment, the cold-flowable material is subject to cold flow at 20° C. In another aspect of this embodiment, the liner inside surface of the first region is in unbonded contact with the liner inside surface of the second region. In another preferred embodiment, the cold-flowable material comprises a hot-melt pressure sensitive adhesive.

In another preferred embodiment of the above wrapped mass of material, the liner comprises a polyethylene liner including a silicone release coating on at least the inside surface. In still another preferred embodiment, the liner comprises a cloth including a silicone release coating on at least the inside surface.

In another preferred embodiment of the above wrapped mass of material, the first and second portions of the wrapped mass of material are portions of a continuous wrapped mass of material. In a variation to this embodiment, the first and second portions are of discrete, discontinuous first and second respective wrapped masses of materials. In another preferred embodiment, the wrapped mass of material is arranged in a coil about a spool and the core of each successive coil contacts the tab of each respective previous coil.

The present invention also provides another embodiment of a wrapped mass of material. The wrapped mass of material includes an elongate mass of cold-flowable material including an outer peripheral surface and a liner. The liner includes an inside surface, an outside surface, a first edge, and a second edge, with the first and second edges opposite to one another. The liner also includes a first region extending along the first edge, a second region extending along the second edge, and a center region between the first and second regions. The liner is wrapped around the cold-flowable material with the liner inside surface at the center region facing the peripheral surface of the cold-flowable material, the liner first and second regions extending away from the cold-flowable material with the liner inside surface of the first region in unbonded contact with the liner inside surface of the second region so as to enclose the cold-flowable material with the liner.

The present invention also provides a wrapped cold-flowable material, comprising an elongate mass of cold-flowable material including an outer peripheral surface and a liner. The liner includes an inside surface, an outside surface, a first edge, and a second edge, with the first and second edges opposite to one another. The liner also includes a first region extending along the first edge, a second region extending along the second edge, and a center region between the first and second regions. The liner is wrapped around the cold-flowable material with the liner inside surface at the center portion facing the peripheral surface of the cold-flowable material, the liner first and second regions extending away from the cold-flowable material with the liner inside surface of the first region in unbonded contact with the liner inside surface of the second region so as to enclose the cold-flowable material with the liner. The mass of cold-flowable material and the center region of the liner together form a core of the wrapped mass of cold-flowable material, and the first region and the second region together form a tab of the wrapped mass of cold-flowable material. The wrapped mass of cold-flowable material includes a first portion and a second portion and is arranged such that the tab of the first portion and the core of the second portion contact one another so as to maintain the mass of cold-flowable material enveloped by the liner at the first portion.

The present invention also provides a wrapped hot melt adhesive, comprising an elongate mass of cold-flowable hot melt adhesive including an outer peripheral surface and a liner. The liner includes an inside surface, an outside surface, a first edge, and a second edge, with the first and second edges opposite to one another. The liner includes a first region extending along the first edge, a second region extending along the second edge, and a center region between the first and second regions. The liner is wrapped around the hot melt adhesive with the liner inside surface at the center region facing the peripheral surface of the hot melt adhesive, the liner first and second regions extending away from the hot melt adhesive with the liner inside surface of the first region in unbonded contact with the liner inside surface of the second region so as to enclose the hot melt adhesive with the liner. The mass of material and the center region of the liner together form a core of the wrapped mass of hot melt adhesive, and the first region and the second region together form a tab of the wrapped mass of hot melt adhesive. The wrapped mass of hot melt adhesive includes a first portion and a second portion and is arranged such that the tab of the first portion and the core of the second contact one another so as to maintain the hot melt adhesive enveloped by the liner at the first portion.

The present invention also provides a method of enclosing a mass of material with a liner. The method includes the steps of: a) contacting a region of an inside surface of an elongate liner with at least a portion of the outer peripheral surface of an elongate mass of material, wherein the liner has first and second regions on opposite side of the center region; b) bringing the first and second regions of the inside surface of the liner together so as to enclose the mass of material with the liner, thereby forming: (i) a core of wrapped mass of material which includes the mass of material and the center region of the liner and (ii) a tab of the wrapped mass of material which includes the first and second regions of the liner; and c) arranging the wrapped mass of material such that the tab of a first portion of the wrapped mass of material and the core of a second portion of the wrapped mass of material contact one another so as to maintain the mass of material enveloped by the liner at the first portion.

In one preferred embodiment of the above method, step a) comprises contacting the liner with an elongate mass of cold-flowable material. In another preferred embodiment of the above method, step a) comprises contacting the liner with an elongate mass of material that is subject to cold flow at 20° C.

In another preferred embodiment of the above method, step c) comprises arranging first and second portions of a single, continuous wrapped elongate material. In an alternate embodiment, step c) comprises winding a first coil of wrapped elongate material about a central spool and subsequently winding a second coil of elongate material about the central spool such the core of the second coil is in contact with the tab of the first coil. In one aspect of this embodiment, the first and second coils are of a single, continuous elongate wrapped mass of material.

In another embodiment, the above method includes the further step of bonding the first and second regions to one another.

In another embodiment of the above method, step a) comprises extruding the mass of material onto the inside surface of the central region of the liner between the first and second regions.

The above inventive method can also include the further steps of: d) removing the core of the second portion of wrapped mass of material from the tab of the first portion; d) separating the first and second regions of the liner to expose the mass of material; and f) removing the mass of material from the liner. The method can also include the further steps of g) contacting the central portion of the inside surface of the elongate liner with at least a portion of the outer peripheral surface of a second elongate mass of material; h) bringing the first and second regions of the inside surface of the liner together so as to enclose the second mass of material with the liner, thereby forming: (i) a core of wrapped material which includes the second mass of material and the center region of the liner and (ii) a tab of the wrapped material which includes the first and second regions of the liner; and i) arranging the second wrapped cold flowable material such that the core of a second portion of the second wrapped material applies sufficient force to the tab of a first portion of the second wrapped cold-flowable material so as to maintain the second mass of cold-flowable material enveloped by the liner at the first portion.

The present invention also provides a method of enclosing a mass of cold-flowable hot melt adhesive with a liner, comprising the steps of: a) contacting a central portion of an inside surface of an elongate liner with at least a portion of the outer peripheral surface of an elongate mass cold-flowable hot melt adhesive, wherein the liner has first and second regions on opposite sides of the center region; b) bringing the first and second regions of the inside surface of the liner together so as to enclose the mass of cold-flowable hot melt adhesive with the liner, thereby forming: (i) a core of wrapped mass of cold-flowable hot melt adhesive which includes the mass of cold-flowable hot melt adhesive and the center region of the liner and (ii) a tab of the wrapped mass of cold-flowable hot melt adhesive which includes the first and second regions of the liner; and c) arranging the wrapped mass of cold-flowable hot melt adhesive such that the tab of a first portion of the wrapped mass cold-flowable hot melt adhesive and the core of a second portion of the wrapped mass of cold-flowable hot melt adhesive contact one another so as to maintain the mass of cold-flowable hot melt adhesive enveloped by the liner at the first portion.

The present invention also provides a method of enclosing a mass of cold-flowable hot melt adhesive with a liner, comprising the steps of: a) contacting a center of an inside surface of an elongate liner with at least a portion of the outer peripheral surface of an elongate mass cold-flowable hot melt adhesive, wherein the liner has first and second regions on opposite side of the center region; b) bringing the first and second regions of the inside surface of the liner together in unbonded contact so as to enclose the mass of cold-flowable hot melt adhesive with the liner, thereby forming: (i) a core of wrapped mass of cold-flowable hot melt adhesive which includes the mass of cold-flowable hot melt adhesive and the center region of the liner and (ii) a tab of the wrapped mass of cold-flowable hot melt adhesive which includes the first and second regions of the liner in unbonded contact; and c) arranging the wrapped mass of cold-flowable hot melt adhesive such that the tab of a first portion of the wrapped mass cold-flowable hot melt adhesive and the core of a second portion of the wrapped mass of cold-flowable hot melt adhesive contact one another so as to maintain the mass of cold-flowable hot melt adhesive enveloped by the liner at the first portion.

In yet another aspect, the present invention provides an apparatus for enclosing a mass of material with a liner. The apparatus comprises a) contacting means for contacting a central portion of an inside surface of an elongate liner with at least a portion of the outer peripheral surface of an elongate mass of material, wherein the liner has first and second regions on opposite side of the center region; b) folding means for folding the liner so as to contact the first and second regions of the inside surface of the liner so as to enclose the mass of material with the liner, thereby forming: (i) a core of wrapped mass of material which includes the mass of material and the center region of the liner and (ii) a tab of the wrapped mass of material which includes the first and second regions of the liner; and c) arranging means for arranging the wrapped cold flowable material such that the core of a second portion of the wrapped mass of material applies sufficient force to the tab of a first portion of the wrapped mass of material so as to maintain the mass of material enveloped by the liner at the first portion.

Certain terms are used in the description and the claims that, while for the most part are well known, may require some explanation. It should be understood that, when referring to the first and second regions of the liner as being in "unbonded" contact, this means that the first and second regions are freely separable from one another and have not been bonded to one another such as by an adhesive, heat sealing, ultrasonic welding, or the like. It should also be understood that when referring to the material as "cold-flowable" this means that the material will exhibit time-dependent non-elastic deformation or strain under an applied load at temperatures below 120° F. (50° C.).

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention provides a wrapped mass of material. A preferred embodiment of the invention provides a cold-flowable material such as a hot-melt pressure sensitive adhesive wrapped in a liner such that the liner is easily removed from the material. The present invention also provides a method and apparatus for wrapping and unwrapping the material with the liner.

The present invention is also useful for difficult to handle materials, such as materials which stick or bond to themselves. The present invention is also useful with materials which are not coherent or strong enough to be drawn through processing or delivery apparatuses themselves, and which are easily transported by drawing the liner which wraps the material. This can include materials in particulate form.

Figure 1:
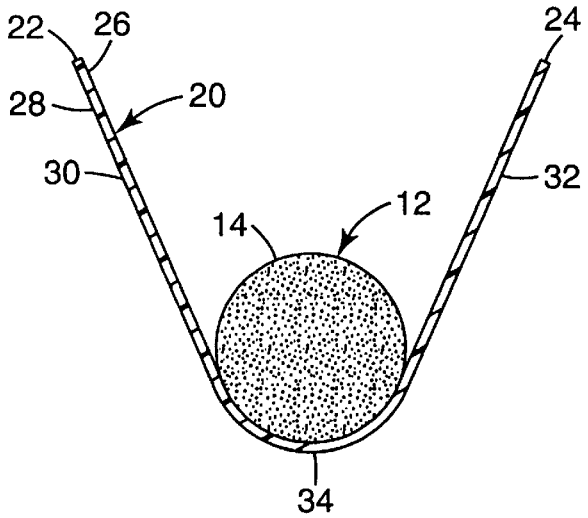
FIG. 1 is a cross section of a mass of material partially enclosed with a liner according to a preferred embodiment of the present invention.

FIG. 1 illustrates a mass of material 12 partially enclosed with a liner 20 according to a first preferred embodiment of the present invention. FIG. 1 shows the material in a partially wrapped state as taken along line I—I of FIG. 8. Referring to FIG. 1, the mass of material 12 has an outer surface 14. Liner 20 includes inside surface 26 which contacts the outer surface 14 of the material 12. Liner 20 also includes outside surface 28. Liner 20 has a first edge 22 and second edge 24 opposite to one another and extending for the length of the liner 20. Liner 20 is illustrated as having three regions: first region 30 extending along the length of the liner adjacent first edge 22; second region 32 extending along the length of the liner adjacent second edge 24; and center region 34 extending the length of the liner between the first region 30 and second region 32. The liner 20 contacts the outer surface 14 of the mass of material at the center portion 34 of the inside surface 26 of the liner.

Figure 2:
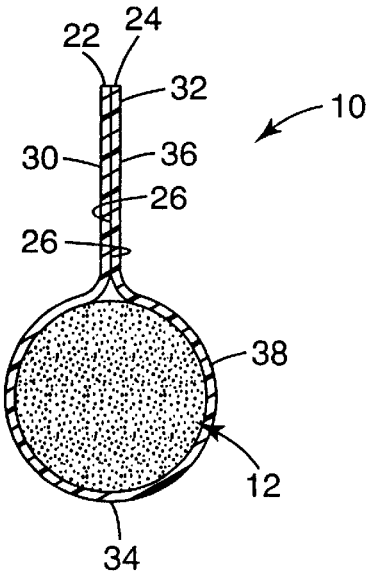
FIG. 2 is a cross-section of a mass of material completely enclosed with a liner according to a preferred embodiment of the present invention.

FIG. 2 illustrates the wrapped material 10 in a fully wrapped state. FIG. 2 is taken along line II—II of FIG. 8. In the illustrated preferred embodiment shown in FIG. 2, the first region 30 and second region 32 of the liner are brought into contact at the inside surface 26 of the liner. Preferably, the first and second edges 22, 24 of the liner are substantially aligned with one another as illustrated, however this is not essential. The first and second regions 30, 32 of the liner together form a tab 36 of the wrapped material 10. The mass of material 12 and the center region 34 of the liner 20 together form a core 38 of the wrapped mass of material 10. In the preferred embodiment of the wrapped material 10 illustrated in FIG. 2, the tab 36 of the wrapped material 12 extends away from the core 38. As illustrated in the preferred embodiment, the center portion 34 of the liner contacts most of the outer surface 14 of the material 12. The entire outer surface 14 of the material 12 can be, but is not required to be, in contact with the liner 20. It is also seen that in the preferred embodiment, the mass of material 12 is generally cylindrical, having a circular cross-section. This is a preferred configuration for the mass of material 12. It is understood, however, that other cross-sectional shapes of material 12 can be advantageously wrapped with liner 20 in accordance with the present invention. For example, the cross section of material 12 can be oval, oblong, tear-drop shaped, or polygonal with either rounded comers or more sharply defined corners.

In a preferred embodiment of the present invention, the first and second regions 30, 32 of the liner 20 are in unbonded contact with one another along the inside surface 26 of the liner. When referring to the first and second regions of the liner as being in "unbonded" contact, this means that the first and second regions are freely separable from one another and have not been bonded to one another such as by an adhesive, heat sealing, ultrasonic welding, or the like. Keeping the liner 20 unbonded facilitates unwrapping the material as will explained in greater detail below. It is also within the scope of the present invention to bond the first and second regions 30, 32 of the liner to one another to enclose the mass of material 12 therein. Such bonding may be by means of an adhesive, heat sealing, ultrasonic welding, mechanical means, or the like, and can be chosen based on the material of the liner 20 and the desired strength of the bond.

Figure 3:
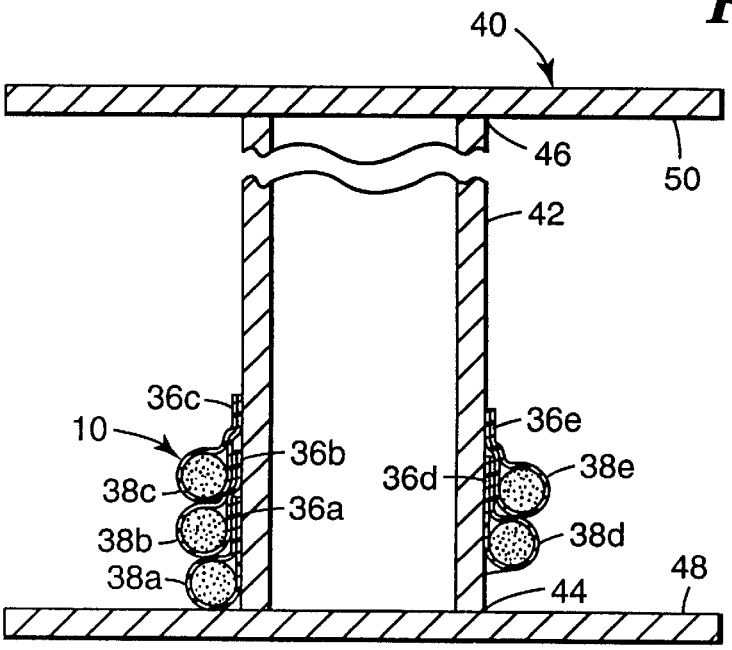
FIG. 3 is a cross-section of a single layer of a wrapped mass of material wound about a spool according to a preferred embodiment of the present invention.

The wrapped mass of material 10 is preferably extremely long relative to the cross-sectional width of the material 12. This allows for convenient handling of large amounts of the material 12 by coiling the wrapped mass of material about a spool assembly 40 as illustrated in FIG. 3. For example, the length of the wrapped material 10 can be in excess of 100 times the cross-sectional width of the material 12, and is preferably in excess of 1000 times the width of the material. It is understood that the present invention is not thereby limited, and that smaller and larger length to width ratios are within the scope of the present invention. As seen in FIG. 3, the wrapped material 10 is arranged in coils about the spool such that the core 38*b* of a second portion of the wrapped mass of material 10 applies sufficient force to the tab 36*a* of a first portion of the wrapped mass of material so as to maintain the mass of material 12 enveloped by the liner 20 at the first portion. Successive coils of the wrapped material are likewise arranged so that the core of each successive coil contacts the tab of each respective preceding coil. That is, core 38*e* contacts tab 36*d;* core 38*c* contacts tab 36*b,* and so on.

Figure 4:
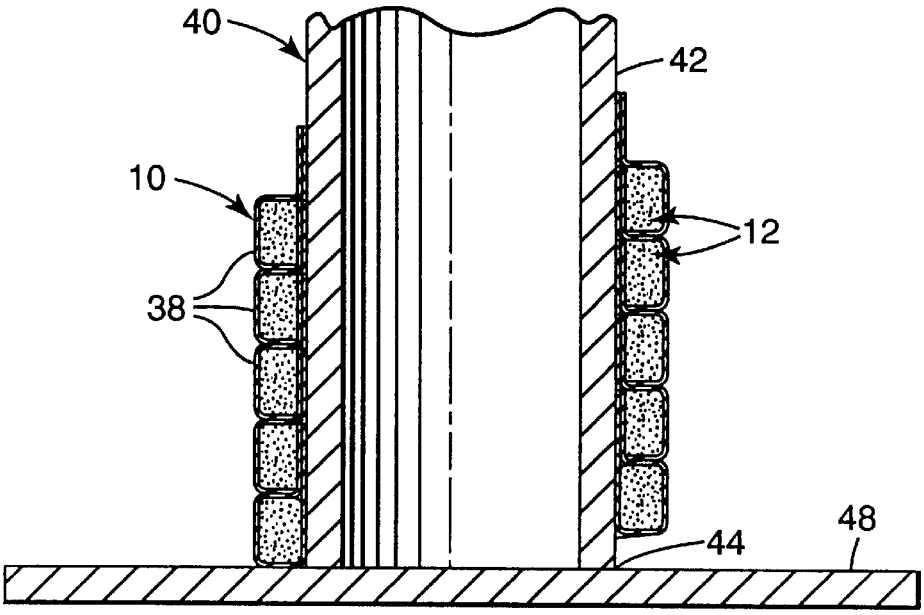
FIG. 4 is a view of the wrapped material of FIG. 3, illustrating a cold-flowable wrapped material after cold flow.

FIG. 4 is a view of the wrapped material of FIG. 3, in which the mass of material 12 is a cold-flowable material and has cold-flowed over time. The cross section of the core 38 of the wrapped material 10 in FIG. 4 has flowed to a generally rectangular cross section, conforming to the periphery of the central spool 42 of the spool assembly 40, and filling the voids that existed between the coils of the initially cylindrical material 12 that had been wound upon the spool assembly 40.

The spool assembly 40 is illustrated in FIGS. 3 and 4 as having a single layer of wrapped material 10 wound about the central spool 42. It is understood that any desired numbers of layers of wrapped material 10 may be wound upon the spool, as determined by the cross sectional size of the core 38 of the wrapped material, the diameter of the central spool 42, and the diameter of the first and second end plates 48, 50, attached to the first and second ends 44, 46 respectively, of the central spool 42. Such multiple layers are illustrated in FIGS. 5–7.

Figure 5:
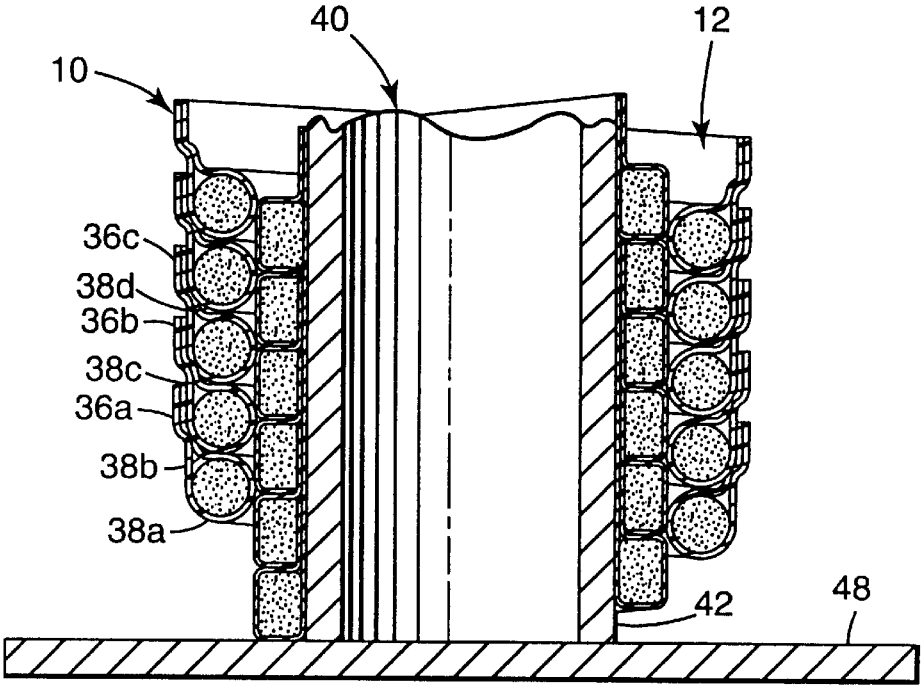
FIG. 5 is a view like FIG. 4, of two layers of a wrapped mass of material wound about a spool according to a preferred embodiment of the present invention.

FIG. 5 illustrates the spool assembly 40 of FIG. 4, in which a second layer of wrapped material 10 has been wound about the first layer of wrapped material 10 already present central spool 42. As described above with respect to the first layer, the second layer is arranged such that tab 36*b* maintains pressure on the core 38*c*; tab 36*a* maintains pressure on core 38*b*, and so on. This pressure between the tabs 36 and the cores 38 on the second layer of wrapped material 10 maintains the mass of material enveloped by the liner 20.

Figure 6:
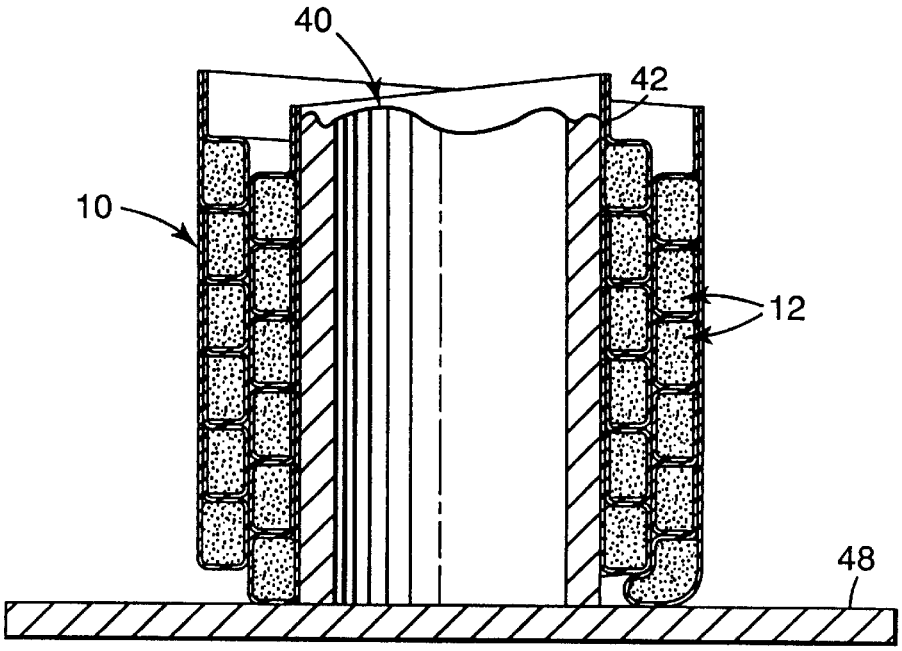
FIG. 6 is a view of the wrapped material of FIG. 5, illustrating a cold-flowable wrapped material after cold flow.

FIG. 6 illustrates the spool assembly 40 and wrapped material 10 of FIG. 5, in which the cold-flowable material 12 of the second layer has cold flowed to conform to the first layer of wrapped material and to fill the voids that existed between the coils of the initially cylindrical material 12 wrapped with liner 20 that had been wound upon the first layer of wrapped material 10. It is also seen that the second layer of wrapped material applies pressure to the first layer, further increasing the force applied to close the tabs 36 in the first layer.

Figure 7:
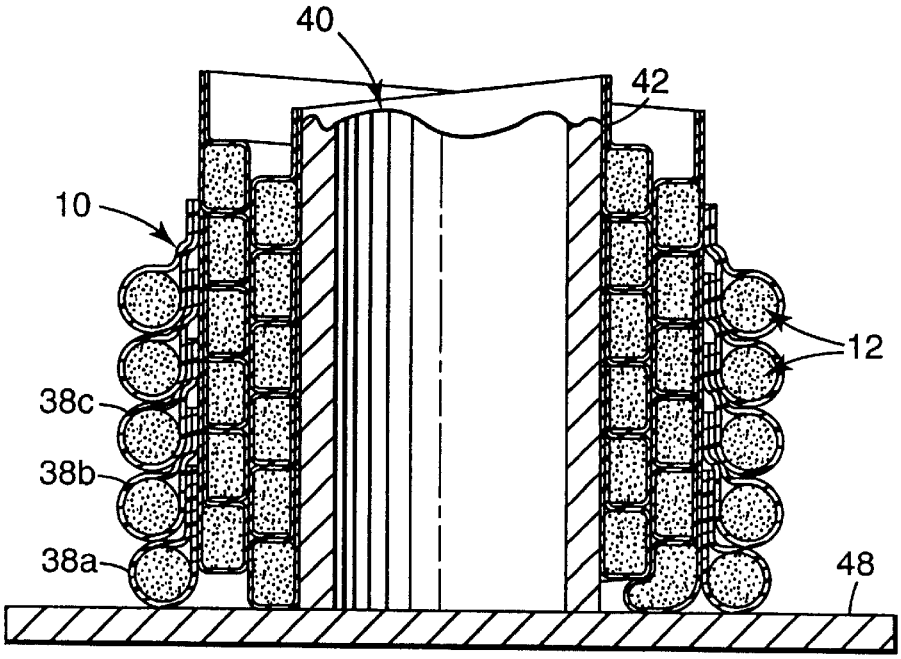
FIG. 7 is a view like FIG. 6, of three layers of a wrapped mass of material wound about a spool according to a preferred embodiment of the present invention.

FIG. 7 illustrates the spool assembly 40 of FIG. 6, in which a third layer of wrapped material 10 has been wound about the second layer of wrapped material 10 already present on the central spool 42. The cores 38 in each coil of the third layer apply force to tabs 36 of each respective preceding coil in the third layer, as described above with respect to the first layer illustrated in FIGS. 3–4. In each of the just-described arrangements, the forces acting on the material 12 are at equilibrium, such that there are no unbalanced forces causing the material 12 to be forced out of the liner 20.

The arrangement of wrapped material 10 illustrated in FIGS. 3–7 allows for the liner first and second regions 30, 32 to be unbonded, while maintaining the first and second regions 30, 32 under sufficient pressure to attenuate leakage of the material 12 from the liner 20. This is especially advantageous when the material 12 is a cold-flowable material. Thus, the present invention maintains the cold flowable material 12 in the liner 20, while allowing the liner to be easily and conveniently removed from the material 12 as discussed below. This provides the advantage of avoiding complex, time consuming, and expensive methods and apparatus for removing the liner from the material. It also allows for convenient re-use of the liner 20 because it is not damaged upon removal from the material 12. It also allows selection of any desired liner material that provides the desired release characteristics for the particular material 12 to be wrapped, without concern for consuming the liner 20 when using a hot-melt pressure sensitive adhesive as the material 12, which previously required using a liner material compatible with the pressure sensitive adhesive. It is understood that relatively small amounts of the material 12 may leak from the liner 20, depending on the material rheology, liner configuration, spool configuration, and other factors, and that the liner will nonetheless be considered to maintain the mass of material enveloped by the liner. It is therefore preferred that the liner 20 have suitable release characteristics on both its inside surface 26 and outside surface 28.

Liners 20 useful in the present invention include woven and nonwoven fabrics, polymeric films, flexible papers, and the like which may be optionally coated or treated with a release material to modify at least the inside surface 26 of the liner, and optionally the outside surface 28 of the liner. Examples of specific materials which are suitable for liner 20 include silicone-coated fabrics, silicone-coated biaxially oriented polyester films, TEFLON films or fabrics, biaxially oriented polypropylene films, polyethylene films, and polyethylene coated fabrics or papers. The choice of the release coating, if any, on the liner 20 is generally selected to obtain desired release characteristics from the particular material 12. For example, a silicone release surface is preferable when material 12 is an acrylate pressure sensitive adhesive, while a TEFLON release surface may be preferable when material 12 is a silicone pressure sensitive adhesives. The liner material, and coating if present, is also chosen to get desired frictional engagement between the first and second regions of the liner 30, 32 when in contact to form tab 36, and to get desired friction between adjacent layers of the wrapped material.

Material 12 can comprise any material which can be held in liner 20. The present invention is particularly well suited for use with pressure sensitive adhesives and heat activated adhesives. Pressure sensitive adhesives are adhesives which are tacky at room temperature and generally have a glass transition temperature below 0° C. Heat activated adhesives are generally non-tacky or slightly tacky at room temperature, but become significantly tacky at elevated temperatures. The present invention is particularly well suited for use with adhesives, and other materials, which are cold-flowable materials, and particularly with materials which are cold-flowable at room temperature (20° C.).

Examples of adhesives which can be wrapped by the present invention include acrylate adhesives, such as those described in U.S. Pat. Nos. Re. 24,906 (Ulrich); 4,833,179; 4,952,650; 5,292,844; 5,374,698; 5,464,916; and co-pending U.S. Pat. application Ser. No. 08/596,897 (Harmer et al); polyalpha-olefin adhesives; and ethylene vinyl acetate adhesives.

The present invention is also useful for adhesives that may not exhibit cold flow, but are tacky or otherwise have a tendency to stick to themselves making handling difficult. Such adhesives include copolymer adhesives such as styrene-isoprene-styrene copolymers, styrene-butadiene copolymers, acrylonitrile rubber copolymers and the like. The copolymers are typically tackified and/or plasticized to make them pressure sensitive. The present invention is also useful with materials which are not coherent or strong enough to be drawn through processing or delivery apparatuses themselves, and which are easily transported by drawing the liner which wraps the material. This can include materials in particulate form.

Figure 8:
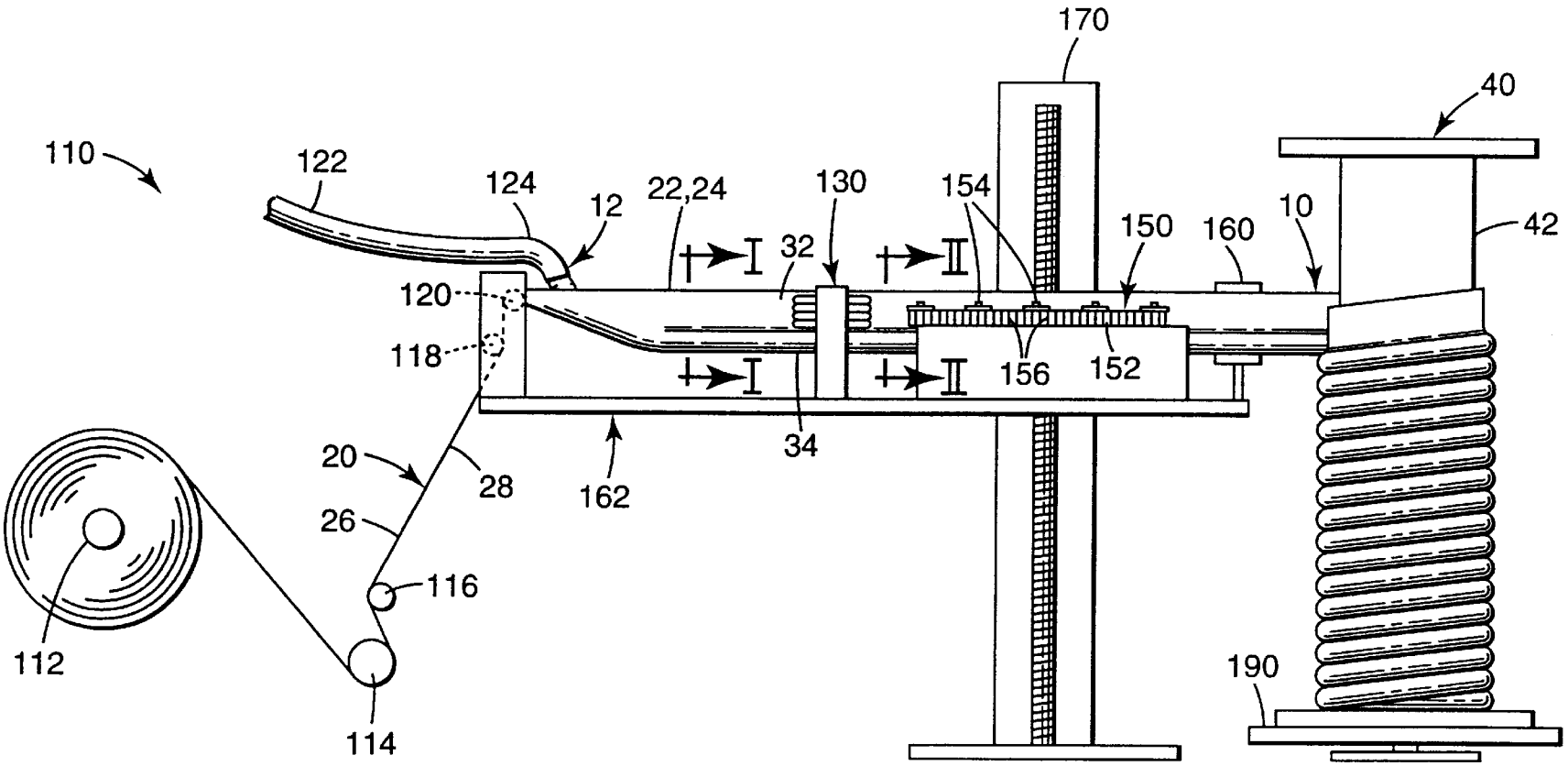
FIG. 8 is a partial schematic view of an apparatus and method for wrapping a mass of material with a liner according to the present invention.

FIG. 8 is a partial schematic view of a wrapping apparatus 110 and method for wrapping a mass of material 12 with a liner 20 according to the present invention. A length of liner 20 is initially provided in roll form at liner spindle 112. The liner 20 progresses along tension sensing roller 114 and idler rollers 116 and 118 and then around speed sensing roller 120. Up until this point, the liner 20 is in a generally planer, unfolded state. After the liner 20 passes over speed sensing roller 120, the mass of material 12 is introduced onto the inside surface 26 of the liner at the center region 34 of the liner (as discussed above with respect to FIG. 1, taken along line I—I of FIG. 8). Material 12 can be prepared at a time or location remote from the wrapping apparatus 110, and then delivered into the wrapping apparatus. Alternatively, the material 12 can be prepared (polymerized, blended, or compounded, for example, as appropriate for the particular material), and then introduced into wrapping apparatus 110 in a continuous process. Furthermore, it is understood that extruding the material 12 through supply tube 122 and exit nozzle 124 is just one of many ways to introduce the material into the wrapping apparatus. The material 12 can be laid in place by any external conveyer. For example, material 12 can be extruded in a film or sheet form, and then repeatedly folded or wrapped upon itself to obtain a generally round cross section and then introduced into the wrapping apparatus.

In the illustrated embodiment, the mass of material 12 is a cold-flowable material, such as a hot-melt pressure sensitive adhesive. The material 12 is extruded in cylindrical form by supply tube 122 through exit nozzle 124, as is commonly known to those of ordinary skill in the art of handling hot-melt materials. It is preferable to position the exit nozzle 124 to introduce the material 12 at a height below the speed sensing roller 120 and the liner height adjusting assembly 130 (described below). This causes the liner 20 to begin to fold in half, with first and second edges 22, 24 of the liner substantially aligned with one another. An optional additional roller (not illustrated) can be positioned where the material 12 is deposited on the liner 20, with the optional roller at a height to force the material down below the edges 22, 24 of the liner 20 to initiate and/or maintain the fold of the liner. Such an optional roller is preferably narrower than the liner 20. The partially enclosed material and liner then progresses through liner height adjusting assembly 130.

Figure 9:
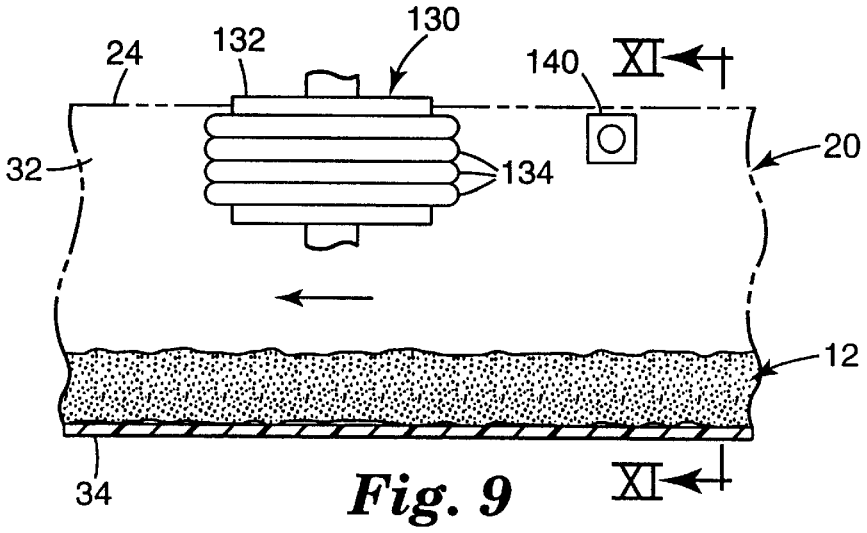
FIG. 9 is an elevational view of the liner, material, and height adjusting assembly of the apparatus of FIG. 8, illustrating the liner at a desired height, with the liner shown in phantom for illustrative purposes.
Figure 10:
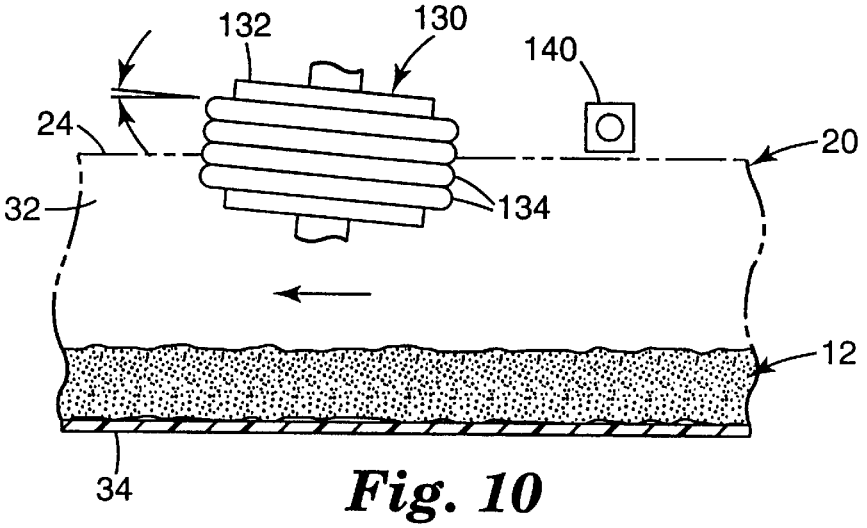
FIG. 10 is a view like FIG. 9, illustrating the liner below the desired height.
Figure 11:
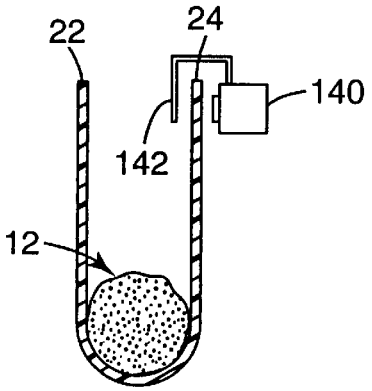
FIG. 11 is a cross sectional view taken along line XI—XI of FIG. 9, illustrating the position of the electric eye and reflector of the apparatus of FIG. 8.

As seen in FIGS. 9–11, liner height assembly 130 includes a first roller 132 with a plurality of gripping rings 134 thereon. The gripping rings 134 are arranged around the circumference of the first roller 132 generally perpendicular to the axis of rotation of the roller. Roller 132 is arranged such that the gripping rings 134 contact the second region 32 of the folded liner 20 on the liner outside surface 28. The materials of the rings is selected to engage the liner with sufficient friction to align the liner as described below. A similarly arranged roller (not illustrated) is provided on the opposite side of the folded liner 20 to contact the first region 30 of the folded liner on the liner outside surface 28. Center region 34 of the liner is seen at the bottom of the folded liner, and contains the material 12 therein.

In one preferred embodiment, the first roller 132 includes rubber gripper rings 134 selected to provide desired frictional engagement with the particular liner 20. Alternative means for handling the liner can be substituted for the roller 132 having gripper rings 134 thereon. All that is required is that the height adjusting assembly 130 be able to engage the liner 20 and apply sufficient force to adjust the height of the edges 22, 24 of the folded liner. For example, any roller type configuration having sufficient frictional contact with the liner can be used. This can include a roller 132 which itself has sufficient friction, or which has thereon any engaging means in place of gripper rings 134.

FIG. 9 is an elevational view of the liner 20, material 12, and height adjusting assembly 130, in a direction looking from within the wrapped material 10, through the second region 32 of the liner 20 (shown in phantom for clarity) to the roller 132. Also seen schematically in FIG. 9 is electric eye 140. When the electric eye determines that the second edge 24 of the liner 20 is at the desired height then the roller 132 is oriented such that the gripper rings 134 are horizontal, so as to direct the liner forward (from right to left in FIG. 9) at a constant height. As seen in FIG. 10, the second edge 24 of the liner has dropped below the desired height. When electric eye 140 senses this, it sends a signal to an actuator (not illustrated) to orient the roller 132 such that the rings 134 are at an angle relative to horizontal, thereby causing the second edge 24 of the liner to move upward as it passes the roller 132. When the liner is again at the desired height, as seen in FIG. 9, the electric eye 140 senses this, and signals the actuator to orient the roller 132 such that the gripper rings 134 are again horizontal. The arrangement of the electric eye 140 is seen in FIG. 11. Electric eye 140 and reflector 142 are oriented such that the liner 20 blocks the light emitted from the electric eye from reflecting off of reflector 142 back to a sensor in the eye. When the liner drops below the desired height, the light signal from the electric eye 140 reflects off of reflector 142 and returns to a sensor in the eye, indicating that the liner is too low. A similar arrangement can be provided for the roller engaging the first region 30 of the liner to maintain the first edge 22 at a desired height.

The electric eye 140 and first roller 132 can operate in a binary mode as described above; that is, the eye determines whether or not the liner height is in a preferred range, and the roller 132 is actuated to a first or second position in response. Alternatively, an analog system can be used, in which the eye senses the position of the edge of the liner and the roller 132 is continuously adjustable within a range of motion depending on the height of the second edge 24 of the liner.

After passing between the height adjusting assembly 130, the first and second regions 30, 32 of the liner 20 are in unbonded contact, with the material 12 contained in the center region 34 of the liner, as described above with respect to FIG. 2. Returning to FIG. 8, the wrapped material 10 then progresses through belt assembly 150. The belt assembly includes an endless toothed belt 152 mounted on rollers 154. The belt 152 is arranged such that the teeth 156 engage with the outside surface 28 of the liner 20 at the second region 32. The belt travels around idler rollers 154 so as to convey the wrapped material 10 to roller 160. A similar belt arrangement (not illustrated) is provided opposite to assembly 150, and is arranged so as to engage the outside surface 28 of the liner at the first region 30. The two belt assemblies are arranged to maintain the first and second regions 30, 32 of the liner in unbonded contact and to allow the core 38 of the wrapped material to pass underneath as the wrapped material 10 is pulled toward the spool by rotation of the spool 40 and driven turntable 190 as described below.

Figure 8A:
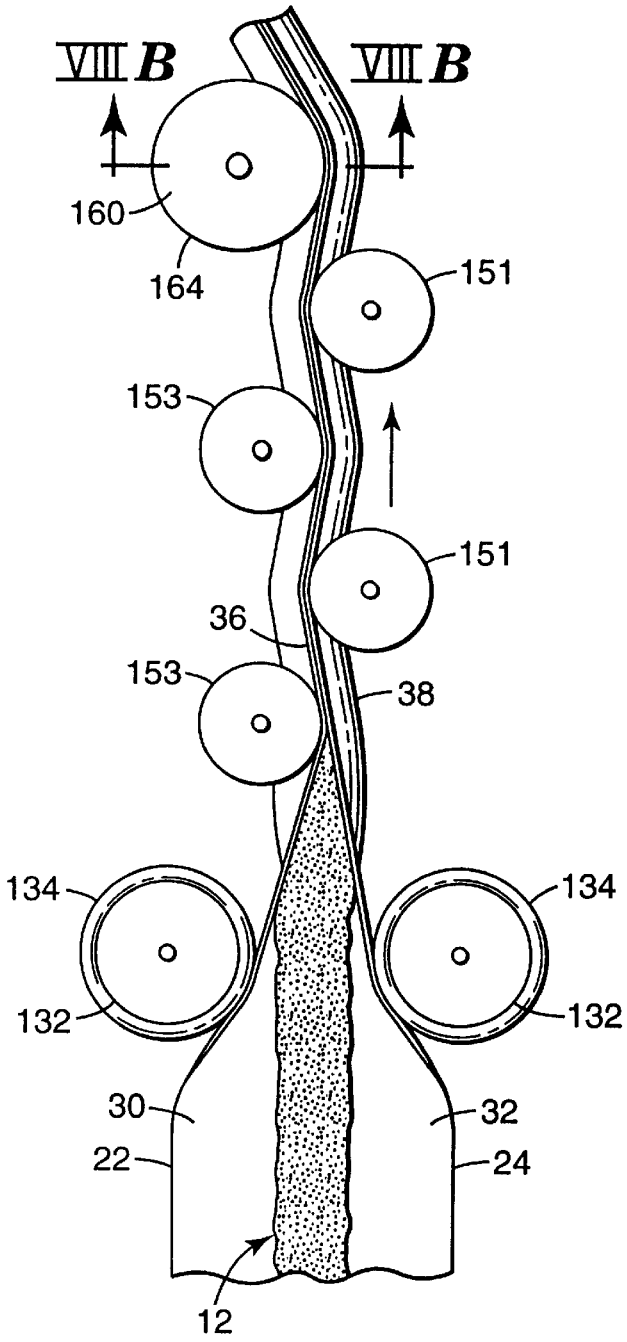
FIG. 8A is a top view of a portion of an alternate embodiment of the apparatus of FIG. 8.

Other arrangements than the belt drive assembly are also within the scope of the present invention. What is required is some arrangement to maintain the first and second regions 30, 32 of the liner together as the wrapped material 10 is pulled toward the spool 40. For example, FIG. 8A is a top view of a conveying means which can be used in place of belt assembly 150. As seen in FIG. 8A, rollers 151 and 153 are arranged on opposite sides of the tab 36 of the wrapped material 10. Rollers 151 engage the outside surface 28 of the liner at second region 32, and rollers 153 engage the outside surface 28 at the first region 30. Rollers 151 and 153 are arranged such that their outer peripheries alternately extend beyond what would otherwise have been a straight line of travel for the wrapped material 10. The rollers are also arranged to engage the tab 36 of the wrapped material while allowing the core 38 to pass beneath the rollers 151, 153.

Figure 8B:
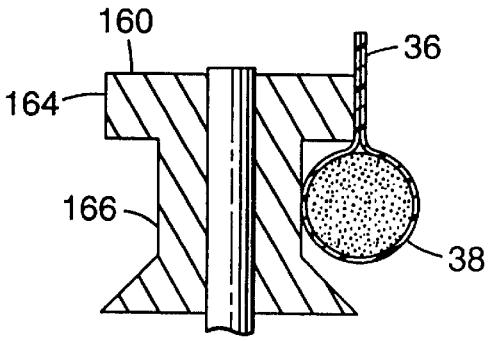
FIG. 8B is a cross sectional view of a roller of the apparatus of FIG. 8 engaging the wrapped material.

A cross section of roller 160 is illustrated in FIG. 8B. Roller 160 includes an extended portion 164 for engaging the tab 36 of the wrapped material 10 as the wrapped material is pulled around roller 160 towards the spool 40. Roller 160 also includes a cavity 166 for engaging the core 38 of the wrapped material. The cavity 166 is sized to have a smaller diameter than extended portion 164.

The wrapped material 10 is then wound about spool assembly 40, as described above with respect to FIG. 3. As seen in FIG. 8, the spool 40 is provided on top of driven turntable 190. Turntable 190 rotates the spool 40 so as to coil the wrapped material about the central spool 42. To facilitate this, frame 162 is mounted on level wind tower 170. Mounted to frame 162 are idler roller 118, speed sensing roller 120, liner height adjustment assembly 130, belt assembly 150 (or rollers 151, 153), and roller 160. Also mounted on the frame 162 is supply tube 122 with exit nozzle 124 for providing material 12 to the liner 20. Frame 162, with the components just described mounted thereon, is raised and lowered by level wind tower 170 as the wrapped material 10 is coiled onto spool 40.

The driven turntable 190 rotates the spool 40, thereby providing the driving force for pulling liner 20 through the wrapping apparatus 110. A variable brake is included in liner spindle 112 to maintain desired tension in the liner 20 as measured at tension sensing roller 114. Speed sensing roller 120 provides feedback to the turntable 190 to maintain the linear speed of the liner 20 constant, at a desired rate selected for the feed rate of material 12 to form the wrapped material 10. As additional layers of wrapped material 10 are added to the spool 40, the effective diameter increases. It is therefore necessary to decrease the rotational speed of the turntable 190 and spool 40 to maintain constant linear speed of the liner 20 at the speed sensing roller 120. The rate of travel of the frame 162 on the level wind tower 170 is controlled so as to be at a constant ratio relative to the rotational speed of turntable 190 and spool 40. This provides the desired height advance (up or down as appropriate) of the wrapped material as it is being wound about the central spool 42. Accordingly, the rate of travel of the frame 162 on the level wind tower 170 decreases proportionately to the decrease in rotational speed of the turntable 190 and spool 40.

Figure 12:
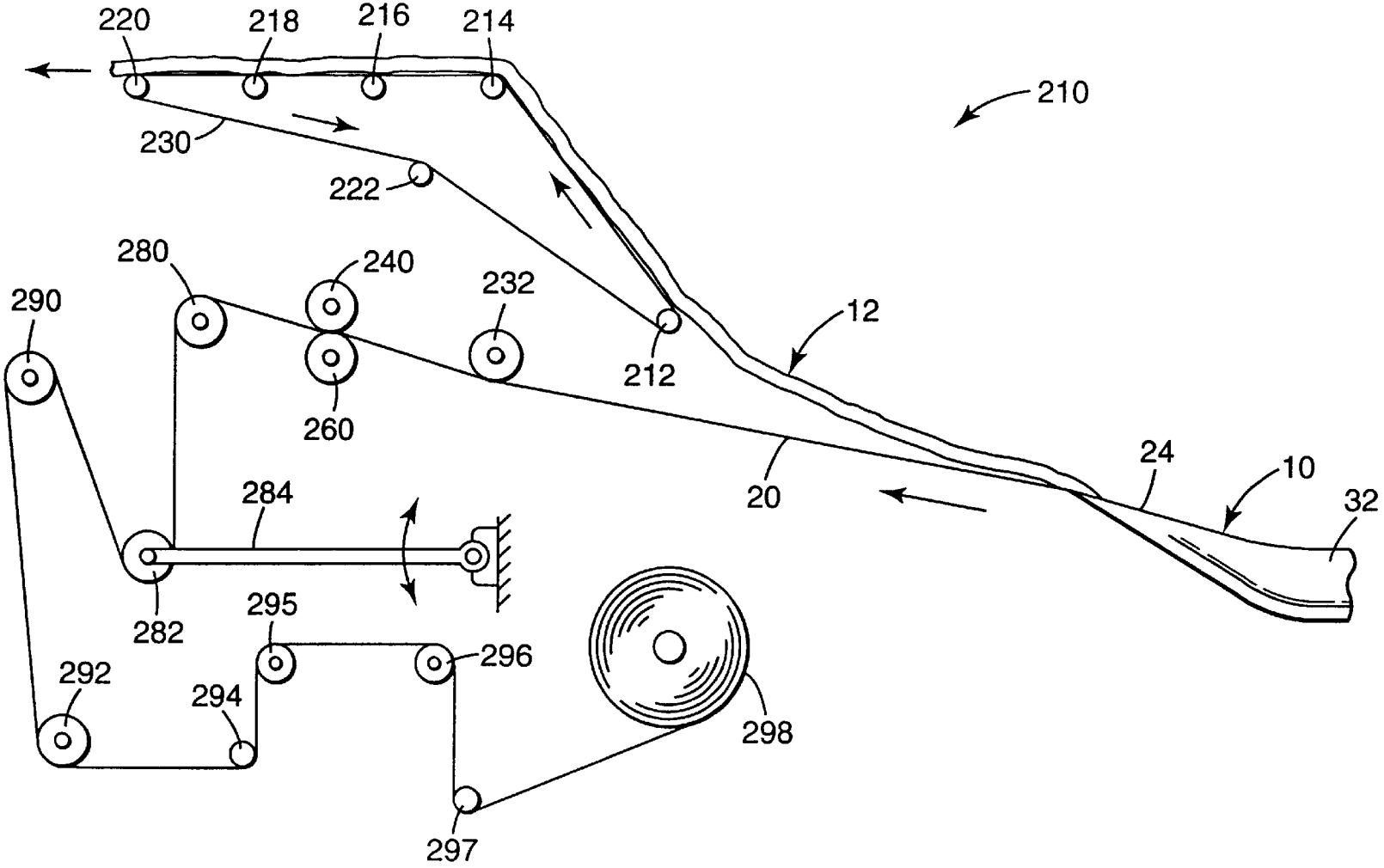
FIG. 12 is a partial schematic view of an apparatus and method for unwrapping a wrapped mass of material from a liner according to the present invention.

FIG. 12 is a partial schematic view of an unwind apparatus 210 and method for unwrapping liner 20 from the mass of material 12. The wrapped mass of material 10 is uncoiled from the spool 40 (not illustrated), and is initially in an enclosed state as illustrated in FIG. 3. Returning to FIG. 12, the mass of material 12 is removed from the liner, and conveyed away on endless conveyor belt 230. The conveyor belt 230 is guided by rollers 212, 214, 216, 218, 220, and 222, of which, 212 is a drive roller with the rest being idler rollers. The mass of material 12 can then be provided to any desired destination, such as the hopper of a hot-melt pressure sensitive adhesive applicator when the material 12 comprises a hot-melt pressure sensitive adhesive.

The liner 20, after being separated from the material 12, is rewound onto liner take-up roll 298 for future use as follows. The liner first passes around idler 232 and then between upper separating assembly 240 and lower separating assembly 260. As described in more detail below, the spreader assemblies maintain the liner 20 in an unfolded state and centered in the unwind apparatus 210. The liner 20 then passes around idlers 280 and 282, and then around drive roller 290. Drive roller 290 maintains the linear speed of the liner 20 at a constant rate, selected as appropriate for the desired rate of feed of the unwrapped mass of material 12. As the layers of wrapped material 10 are unwound from the spool 40, the effective diameter decreases. Therefore, the rotational speed of the spool 40 must be increased to maintain constant linear speed of the liner at drive roller 290. Idler roller 282 is mounted on pivotable arm 284. The roller 282 and arm 284 can have a desired weight or force applied to maintain the desired tension in the liner 20. A sensor on pivot arm 284 is used to determine when the motion of the arm exceeds an acceptable range in either direction. When the arm pivots too far upward, this is an indication that the spool 40 is not unwinding fast enough to keep up with drive roller 290, and the unwind speed of the spool 40 is then increased. When the roller 282 and pivot arm 284 pivot downwards out of the desired range of motion, this indicates that the spool 40 is unwinding too quickly for the speed of the drive roller 290, and the speed of unwind of the spool 40 is accordingly decreased. Instead of the arrangement illustrated, it is also within the scope of the present invention to adjust the unwind speed of the spool 40 by other means. For example, the idler roller 284 can be mounted on a vertical slide means or dancer with a preselected allowable vertical range of motion to determine when the spool speed should be adjusted.

After passing around drive roller 290, the liner 20 can optionally pass around tension sensing roller 292, idler rollers 294, 295, 296 and 297, and onto take-up roll 298. The tension sensing roller 292 provides feedback to a brake in liner take-up roll 298 to maintain the desired tension on the liner 20 as it is wound onto liner take-up roll 298. It is also possible to include an optional web edge guide just prior to the take-up roll as desired.

Figure 13:
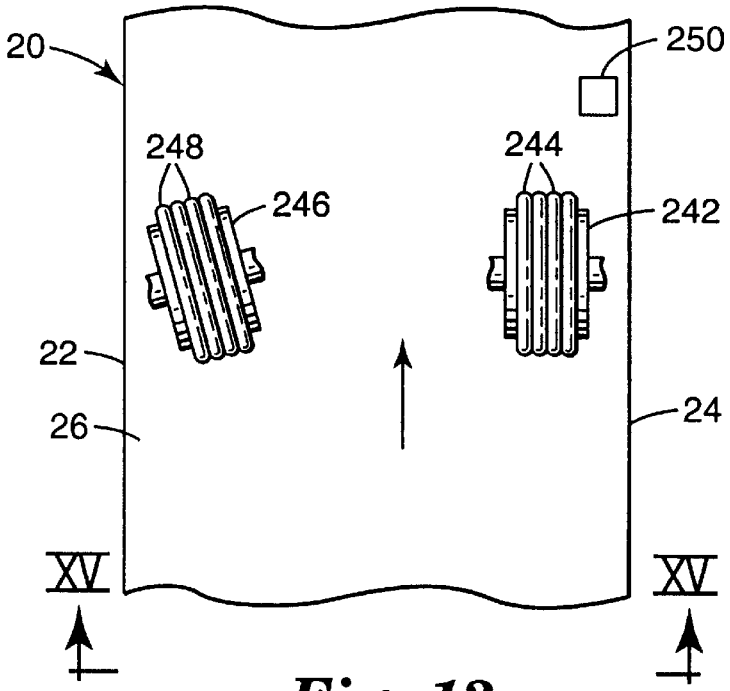
FIG. 13 is a top view of an upper spreader assembly of the apparatus of FIG. 12, illustrating the liner in a desired location.

The operation of the upper and lower spreader assemblies 240, 260 is shown in FIGS. 13–16. FIG. 13 is a top plan view of the liner 20 passing under the upper spreader assembly 240. Upper spreader assembly includes a first upper roller 242 having four gripping rings 244 mounted thereon. The first upper roller 242 is positioned such that the gripping rings 244 engage the inside surface 26 of the liner 20 at second region 32 adjacent second edge 24. As seen in FIG. 13, the first upper roller 242 is in a first position, in which the gripping rings 244 are parallel to the direction of motion of the liner 20. The upper spreader assembly also includes second upper roller 246 having a plurality of gripping rings 248 mounted thereon. The second upper roller is positioned such that the gripping rings 248 engage the inside surface 26 of the liner at first region 30 adjacent first edge 22. The gripping rings 248 are oriented to provide an outward force towards the first edge 22 as the liner traverses past the upper spreader assembly 240.

Figure 15:
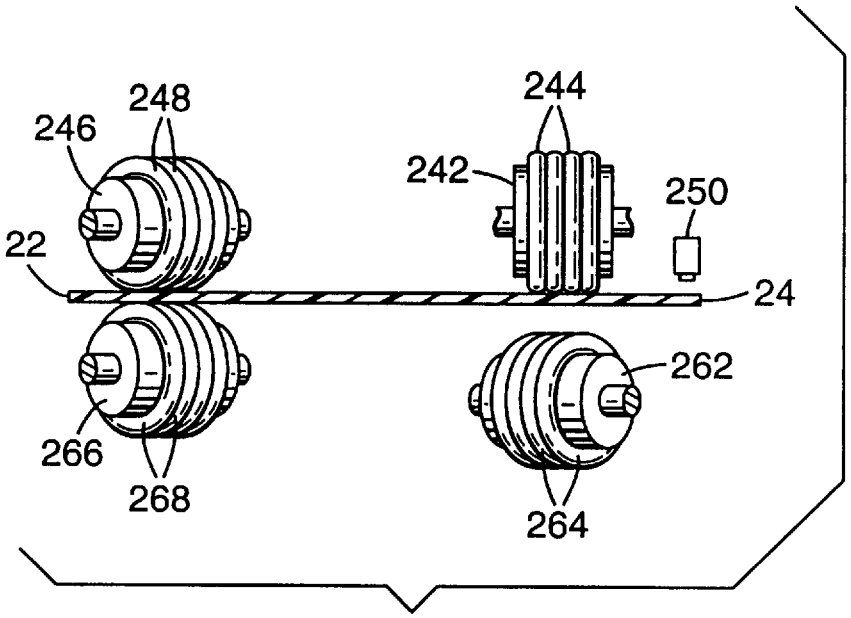
FIG. 15 is a view along line XV—XV of FIG. 13, illustrating the upper and lower spreader assemblies of the apparatus of FIG. 12 in a first position.

FIG. 15 illustrates the lower spreader assembly, and its interaction with the upper spreader assembly 240. Lower spreader assembly 260 includes first lower roller 262 having four gripping rings 264 mounted thereon, and second lower roller 266 having four gripping rings 268 mounted thereon. Both the first and second lower rollers 262, 266 are mounted on pivoting arms (not illustrated) such that they may be brought into contact selectively with the outside surface 28 of the liner 20. When in its upper position, the first lower roller 262 is oriented such that its gripping rings 264 contact the outside surface 28 of the liner 20 at the second region 32 adjacent the second edge 24. The gripping rings 264 are oriented to provide an outward force towards the second edge 24 when engaged with the liner 20. When in its upper position, the second lower roller 266 is oriented such that its gripping rings 268 contact the liner outside surface 28 at the first region 30 adjacent the first edge 22. The gripping rings 268 are oriented to provide an outward force towards the first edge 22 when engaged with the liner.

In one preferred embodiment, rollers 242, 246, 262, 266 have rubber rings 244, 248, 264, 268 thereon, selected to provide desired engagement with the particular liner 20. Alternative means for handling the liner can be substituted for the rollers having rubber rings thereon. All that is required is that the spreader assemblies be able to engage the liner and apply sufficient force to adjust the liner as described above. For example, any roller type configuration having sufficient frictional contact with the liner can be used. This can include a roller which itself has sufficient friction, or which has thereon any engaging means in place of the rings described herein.

As illustrated in FIGS. 13 and 15, when the electric eye 250 senses that the second edge 24 of the liner is in an acceptable position, the first upper roller 242 is oriented such that gripping rings 244 are parallel to the direction of motion to the liner; the second upper roller 246 and second lower roller together apply an outward force in the direction of the liner first edge 22. The outward force applied by second upper roller 246 and second lower roller 266 acts together with the force imparted by the first upper roller 242 to maintain the liner 20 under tension across its width, thus keeping the liner taut and unfolded.

Figure 14:
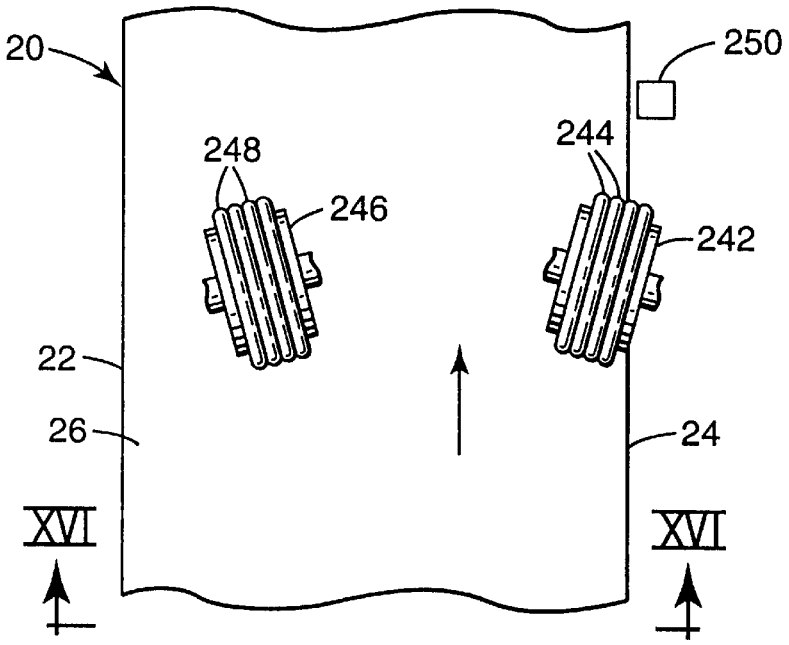
FIG. 14 is a view like FIG. 13 illustrating the liner shifted out of the desired location.
Figure 16:
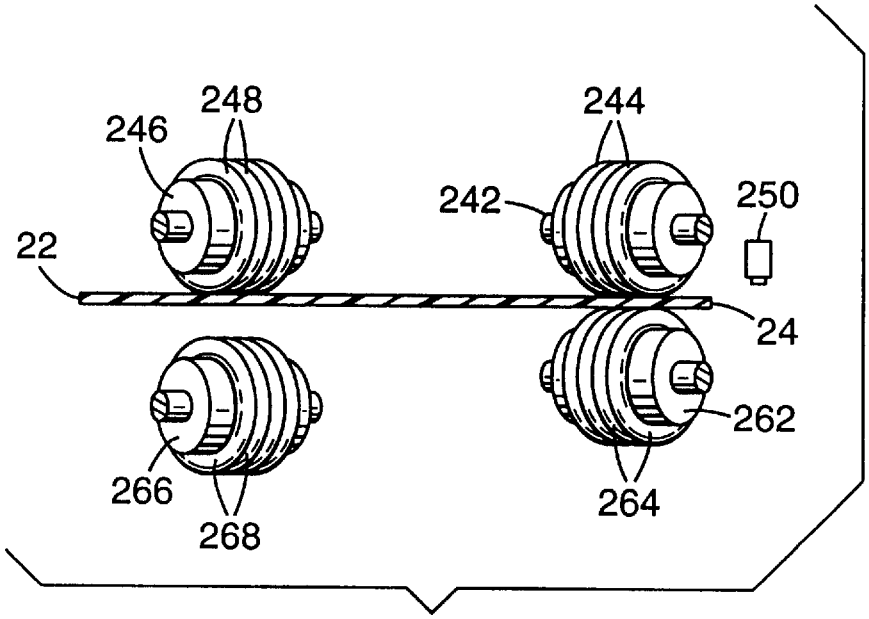
FIG. 16 a view along line XVI—XVI of FIG. 14, illustrating the upper and lower spreader assemblies of the apparatus of FIG. 12 in a second position.

Electric eye 250 senses whether position of the second edge 24 of the liner is within an acceptable range. When the liner 20 has shifted too far in the direction of the 30 second upper roller 246, as seen in FIGS. 14 and 16, the first upper roller 242 is shifted to a second position in which the gripping rings 244 apply an outward force in the direction of the second edge 24 of the liner. The first lower roller 262 contacts the outside surface 28 of the liner opposite the first upper roller 242. The rings 264 of the first lower roller also apply a force in the same direction as the first upper roller 242. The second lower roller 266 shifts away from the outside surface 28 of the liner, and no longer applies force to the liner. In the arrangement shown in FIGS. 14 and 16, the liner 20 is urged in a direction toward the second edge 24 of the liner. When the electric eye 250 senses that the liner 20 has returned to its desired position, then the upper and lower spreader assemblies 240, 260, return to the configuration illustrated in FIGS. 13 and 15.

Figure 17:
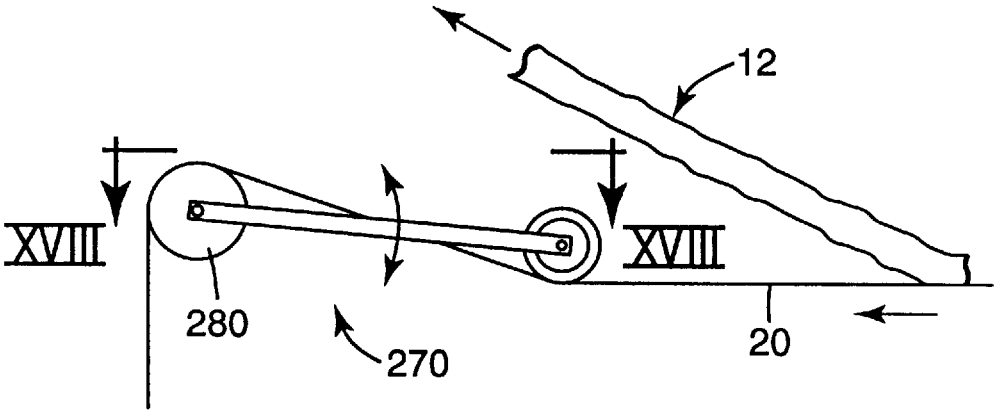
FIG. 17 is a partial view of the apparatus of FIG. 12, illustrating an alternate embodiment of a spreader assembly.
Figure 18:
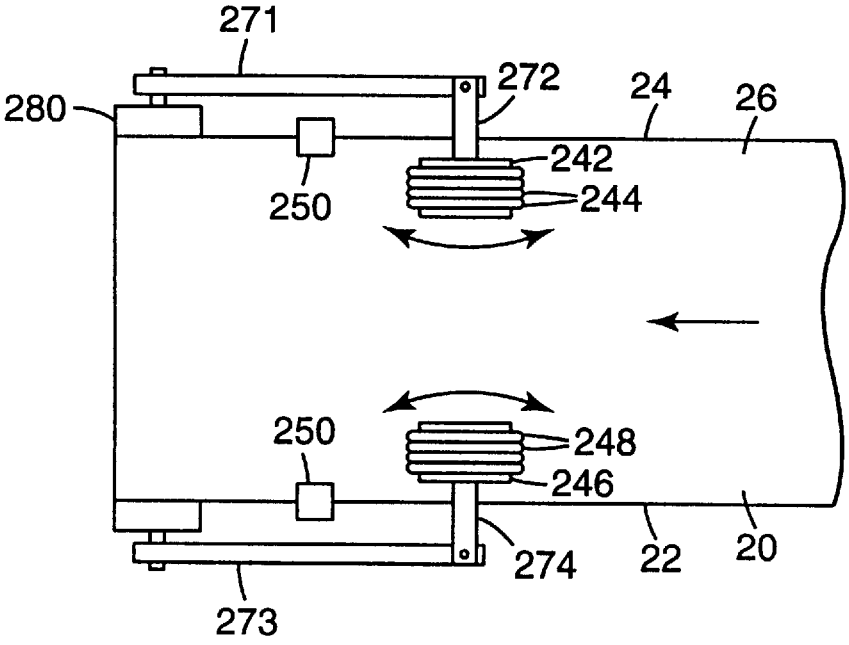
FIG. 18 is a plan view in direction XVIII—XVIII of FIG. 17 showing the spreader assembly.

FIGS. 17–18 illustrate an alternate spreader assembly 270, in place of upper and lower spreader assemblies 240, 260. As seen in FIG. 17, spreader assembly 270 engages liner 20 after material 12 has been pulled away as described above, and before the liner passes over idler roller 280. As seen in FIG. 18, spreader assembly 270 includes first spreader arm 271 and second spreader arm 273. The spreader arms 271, 273 are pivotally mounted about the central axis of roller 280. This allows the arms 271, 273 to freely pivot up and down to maintain engagement between spreader assembly 270 and the inside surface 26 of the liner 20. If desired, weight can be added to the arms 271, 273 to maintain a desired force of engagement. The location of mounting the arms 271, 273 is not critical to the operation of the invention. The arms 271, 273 could be mounted elsewhere, provided the spreader assembly 270 engages the liner 20 in approximately the same location as that illustrated.

First spreader arm 271 has a first roller arm 272 pivotally mounted to the end of the arm 271 opposite to where arm 271 is mounted to the roller 280. Mounted on first roller arm 272 is a first roller 242, as described above with respect to the embodiment illustrated in FIGS. 13–16. First roller arm 272 is pivotally mounted to the spreader arm 271 allowing the first roller 242 to be oriented in a range of motion such that the gripper rings 244 can direct the second edge 24 of the liner 20 to either side, or parallel to the direction of motion of the liner. Similarly, second spreader arm 273 has a second roller arm 274 pivotally mounted to the end of the arm 273 opposite to where arm 273 is mounted to the roller 280. Mounted on second roller arm 274 is a second roller 246, as described above with respect to the embodiment illustrated in FIGS. 13–16. Second roller arm 274 is pivotally mounted to the second spreader arm 273 allowing the second roller 246 to be oriented in a range of motion such that the gripper rings 248 can direct the first edge 22 of liner 20 to either side, or parallel to the direction of motion of the liner. Electric eyes 250 determine whether each edge 22, 24 of the liner 20 is located within an allowable range of position. The electric eyes send a signal that causes either or both of the first and second rollers 242, 246 to pivot to cause the liner to shift in either direction as required, and to maintain the liner spread taut across its width.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. For example, the liner can be chosen so as to be compatible with the hot melt adhesive, thus making it unnecessary to unwrap the hot melt adhesive before use. Also, it is possible to arrange discontinuous segments of wrapped material onto one another such that the core of one portion applies force to the tab of another portion, such as by laying portions of wrapped material next to one another in a container, or by wrapping individual portions in a cylindrical direction about a spool, rather than helically wrapping a continuous wrapped material about the spool. Furthermore, it is possible to have a second strip of material between the first and second regions of the liner when the liner is folded over the mass of material so as to make it easier to open the liner to unwrap the material. Thus, the scope of the present invention should not be limited to the exact details and structures described herein, but rather by the structures described by the language of the claims, and the equivalents of those structures.

What is claimed is:

1. A wrapped mass of material, comprising:

an elongate mass of material including an outer peripheral surface; and a liner including an inside surface, an outside surface, a first edge, and a second edge, wherein said first and second edges are opposite to one another;

wherein said liner includes a first region extending along said first edge, a second region extending along said second edge, and a center region between said first and second regions;

wherein said liner is wrapped around said mass of material with said liner inside surface at said center region facing said peripheral surface of said mass of material, said liner first and second regions extending away from said mass of material with said liner inside surface of said first region contacting said liner inside surface of said second region so as to enclose said mass of material within said liner;

wherein said mass of material and said center region of said liner together form a core of said wrapped mass of material, and wherein said first region and said second region together form a tab of said wrapped mass of material; and wherein said wrapped mass of material includes a first portion and a second portion and wherein said wrapped mass of material is arranged such that said tab of said first portion and said core of said second portion contact one another so as to maintain said mass of material enveloped by said liner at said first portion.

2. A wrapped mass of material according to claim 1, wherein said mass of material comprises a cold-flowable material.

3. A wrapped mass of material according to claim 2, wherein said cold-flowable material comprises a hot-melt pressure sensitive adhesive.

4. A wrapped mass of material according to claim 2, wherein said cold-flowable material is subject to cold flow at 20° C.

5. A wrapped mass of material according to claim 2, wherein said liner inside surface of said first region is in unbonded contact with said liner inside surface of said second region.

6. A wrapped mass of material according to claim 1, wherein said liner comprises a polyethylene liner including a silicone release coating on at least said inside surface.

7. A wrapped mass of material according to claim 1, wherein said liner comprises a cloth including a silicone release coating on at least said inside surface.

8. A wrapped mass of material according to claim 1, wherein said first and second edges are substantially aligned with one another.

9. A wrapped mass of material according to claim 1, wherein said first and second portions of said wrapped mass of material are portions of a continuous wrapped mass of material.

10. A wrapped mass of material according to claim 1, wherein said first and second portions are of discrete, discontinuous first and second respective wrapped masses of materials.

11. A wrapped mass of material according to claim 1, wherein said wrapped mass of material is arranged in a coil about a spool and wherein the core of each successive coil contacts the tab of each respective previous coil.

12. A wrapped cold-flowable material, comprising:

an elongate mass of cold-flowable material including an outer peripheral surface; and a liner including an inside surface, an outside surface, a first edge, and a second edge, wherein said first and second edges are opposite to one another;

wherein said liner includes a first region extending along said first edge, a second region extending along said second edge, and a center region between said first and second regions;

wherein said liner is wrapped around said cold-flowable material with said liner inside surface at said center region facing said peripheral surface of said cold-flowable material, said liner first and second regions extending away from said cold-flowable material with said liner inside surface of said first region in unbonded contact with said liner inside surface of said second region so as to enclose said cold-flowable material with said liner.

13. A wrapped cold-flowable material, comprising:

an elongate mass of cold-flowable material including an outer peripheral surface; and a liner including an inside surface, an outside surface, a first edge, and a second edge, wherein said first and second edges are opposite to one another;

wherein said liner includes a first region extending along said first edge, a second region extending along said second edge, and a center region between said first and second regions;

wherein said liner is wrapped around said cold-flowable material with said liner inside surface at said center region facing said peripheral surface of said cold-flowable material, said liner first and second regions extending away from said cold-flowable material with said liner inside surface of said first region in unbonded contact with said liner inside surface of said second region so as to enclose said cold-flowable material with said liner;

wherein said mass of cold-flowable material and said center region of said liner together form a core of said wrapped mass of cold-flowable material, and wherein said first region and said second region together form a tab of said wrapped mass of cold-flowable material; and wherein said wrapped mass of cold-flowable material includes a first portion and a second portion and wherein said wrapped mass of cold-flowable material is arranged such that said tab of said first portion and said core of said second portion contact one another so as to maintain said mass of cold-flowable material enveloped by said liner at said first portion.

14. A wrapped hot melt adhesive, comprising:

an elongate mass of cold-flowable hot melt adhesive including an outer peripheral surface; and a liner including an inside surface, an outside surface, a first edge, and a second edge, wherein said first and second edges are opposite to one another;

wherein said liner includes a first region extending along said first edge, a second region extending along said second edge, and a center region between said first and second regions;

wherein said liner is wrapped around said cold-flowable hot melt adhesive with said liner inside surface at said center region facing said peripheral surface of said cold-flowable hot melt adhesive, said liner first and second regions extending away from said cold-flowable hot melt adhesive with said liner inside surface of said first region in unbonded contact with said liner inside surface of said second region so as to enclose said cold-flowable hot melt adhesive with said liner;

wherein said mass of cold-flowable hot melt adhesive and said center region of said liner together form a core of said wrapped mass of cold-flowable hot melt adhesive, and wherein said first region and said second region together form a tab of said wrapped mass of cold-flowable hot melt adhesive; and wherein said wrapped mass of cold-flowable hot melt adhesive includes a first portion and a second portion and wherein said wrapped mass of cold-flowable hot melt adhesive is arranged such that said tab of said first portion and said core of said second portion contact one another so as to maintain said mass of material enveloped by said liner at said first portion.

* * * * *